US009731174B2

(12) United States Patent
Mizutani

(10) Patent No.: US 9,731,174 B2
(45) **Date of Patent: *Aug. 15, 2017**

(54) GOLF CLUB HEAD

(71) Applicant: DUNLOP SPORTS CO. LTD., Kobe-shi, Hyogo (JP)

(72) Inventor: Naruhiro Mizutani, Kobe (JP)

(73) Assignee: DUNLOP SPORTS CO. LTD., Kobe-Shi, Hyogo (JP)

( * ) Notice: Subject to any disclaimer, the term of this patent is extended or adjusted under 35 U.S.C. 154(b) by 51 days.

This patent is subject to a terminal disclaimer.

(21) Appl. No.: 14/862,642

(22) Filed: Sep. 23, 2015

(65) Prior Publication Data

US 2016/0008683 A1 Jan. 14, 2016

Related U.S. Application Data

(63) Continuation of application No. 13/933,810, filed on Jul. 2, 2013, now Pat. No. 9,168,430.

(30) Foreign Application Priority Data

Jul. 13, 2012 (JP) ..... 2012-157883

(51) Int. Cl.

| | |
|---|---|
| ***A63B 53/04*** | (2015.01) |
| ***A63B 53/06*** | (2015.01) |
| *A63B 60/00* | (2015.01) |
| *A63B 60/42* | (2015.01) |

(52) U.S. Cl.

CPC ..... *A63B 53/0466* (2013.01); *A63B 60/42* (2015.10); *A63B 2053/0408* (2013.01); *A63B 2053/0433* (2013.01); *A63B 2053/0491* (2013.01); *A63B 2060/002* (2015.10)

(58) Field of Classification Search

CPC ..... A63B 53/0466; A63B 2053/0433; A63B 2053/0491; A63B 2060/002; A63B 60/42; A63B 2053/0408

USPC ..... 473/324–350, 287–292

See application file for complete search history.

(56) References Cited

U.S. PATENT DOCUMENTS

| | | | |
|---|---|---|---|
| 4,795,159 | A | 1/1989 | Nagamoto |
| 5,154,424 | A | 10/1992 | Lo |
| 5,316,305 | A | 5/1994 | McCabe |
| 5,501,459 | A | 3/1996 | Endo |
| 6,056,649 | A | 5/2000 | Imai |
| 6,162,132 | A | 12/2000 | Yoneyama |
| 6,773,360 | B2 | 8/2004 | Willett et al. |
| 7,153,220 | B2 | 12/2006 | Lo |
| 7,294,065 | B2 | 11/2007 | Liang et al. |
| 7,377,860 | B2 | 5/2008 | Breier et al. |

(Continued)

FOREIGN PATENT DOCUMENTS

| | | |
|---|---|---|
| JP | 2010-88807 A | 4/2010 |
| JP | 2010-142448 A | 7/2010 |
| JP | 2011-19843 A | 2/2011 |

*Primary Examiner* — Sebastiano Passaniti

(74) *Attorney, Agent, or Firm* — Birch, Stewart, Kolasch & Birch, LLP

(57) ABSTRACT

A hollow golf club head comprises a head main body made of a metallic material and having a bottom portion including a first portion and a second portion being connected with the first portion having difference in level, and at least one weight member having a specific gravity larger than that of the head main body and attached to the second portion of the head main body.

20 Claims, 10 Drawing Sheets

(56) References Cited

U.S. PATENT DOCUMENTS

| | | | | |
|---|---|---|---|---|
| 7,377,861 | B2 | 5/2008 | Tateno et al. | |
| 7,455,600 | B2 | 11/2008 | Imamoto et al. | |
| 7,462,110 | B2 | 12/2008 | Yamamoto | |
| 7,530,903 | B2 | 5/2009 | Imamoto et al. | |
| 7,572,193 | B2 | 8/2009 | Yokota | |
| 7,572,194 | B2 | 8/2009 | Yamamoto | |
| 7,637,823 | B2 | 12/2009 | Shimazaki et al. | |
| 7,775,904 | B2 | 8/2010 | Hirano | |
| 7,837,577 | B2 | 11/2010 | Evans | |
| 8,016,694 | B2 | 9/2011 | Llewellyn et al. | |
| 8,197,357 | B1 * | 6/2012 | Rice ..... | A63B 53/0466 473/334 |
| 2003/0130059 | A1 | 7/2003 | Billings | |
| 2005/0043115 | A1 | 2/2005 | Lin | |
| 2005/0148405 | A1 | 7/2005 | Imamoto | |
| 2006/0105856 | A1 | 5/2006 | Lo | |
| 2010/0160074 | A1 | 6/2010 | Wada et al. | |
| 2011/0014995 | A1 | 1/2011 | Wada et al. | |

* cited by examiner

GOLF CLUB HEAD

CROSS REFERENCE

The present application is a 37 C.F.R. §1.53(b) continuation of, and claims priority to, U.S. application Ser. No. 13/933,810, filed Jul. 2, 2013. Priority is also claimed to Japanese Application No. 2012-157883 filed on Jul. 13, 2012. The entire contents of each of these applications are hereby incorporated by reference.

BACKGROUND OF THE INVENTION

Field of the Invention

The present invention relates to a golf club head which delivers low hitting sound for golfers.

Description of the Related At

The Japanese patent application laid-open No. 2010-142448 discloses a hollow golf club head which comprises a head main body having a sole portion with a specific area and a weight member attached to the sole portion of the head main body so that the club head has a primary natural frequency in a range of not more than 2,400 Hz for delivering low hitting sound.

The Japanese patent application laid-open No. 2010-88807 discloses a hollow golf club head which comprises a head main body having a stepped sole portion including a plurality of sole surfaces with difference in level and a plurality of weight members each of which is attached to each sole surface for delivering excellent directional stability of a hit ball.

The Japanese patent application laid-open No. 2011-19843 discloses a hollow golf club head which comprises a head main body having a sole portion including a front region, rear region, and a middle region having the smallest thickness. Additionally, the location of the middle region is decided to a certain region where the antinode in the primary natural mode of the head appears, for delivering high hitting sound.

It is well known that ball hitting sound of golf clubs is important for most golfers. Especially, preferable ball hitting sound is the key to lower golf scores for professional golfers or the like. Therefore, ball hitting sound is the one of the most important technical factors for golf clubs. Recently, professional golfers or the like tend to use or request golf clubs that produce lower hitting sound instead of higher hitting sound.

In view of diversity of most professional golfer's demands, an object of the present invention is to provide a golf club head which produces lower hitting sound using a simple structure.

SUMMARY OF THE INVENTION

In accordance with one aspect of the present invention, there is provided a hollow golf club head comprising ahead main body made of a metallic material and having a bottom portion which comprises a first portion and a recess having a height from a plane containing a surface of the first portion in a direction towards an inner hollow part of the club head, the bottom portion recess comprising a toe-side primary portion, a heel-side primary portion, and a secondary portion provided between the heel-side portion and the toe-side portion, wherein the height of the toe-side primary portion and the height of the heel-side primary portion are both greater than the height of the secondary portion, and at least one weight member having a specific gravity larger than that of said head main body and attached to the second portion of said head main body.

Preferably, the second portion is dented from the first portion toward inside the head, or protrudes from the first portion toward outside the head.

Preferably, the recess has a thickness smaller than that of the remainder of the bottom portion around the recess.

Preferably, the second portion has a thickness in a range of from 0.5 to 2.0 mm.

Preferably, the difference between thicknesses of the bottom portion recess and the remainder of the bottom portion around the recess is in a range of not less than 0.1 mm.

Preferably, the second portion is provided so as to surround the weight member in a bottom view of the head.

Preferably, at least one weight member comprises two separate weight members.

Preferably, the second portion comprises two primary portions and a secondary portion provided between the primary portions, each primary portion has larger difference in level than that of the secondary portion with respect to the first portion, and each weight member is attached in each primary portion.

DESCRIPTION OF THE PREFERRED EMBODIMENTS

Figure 1:
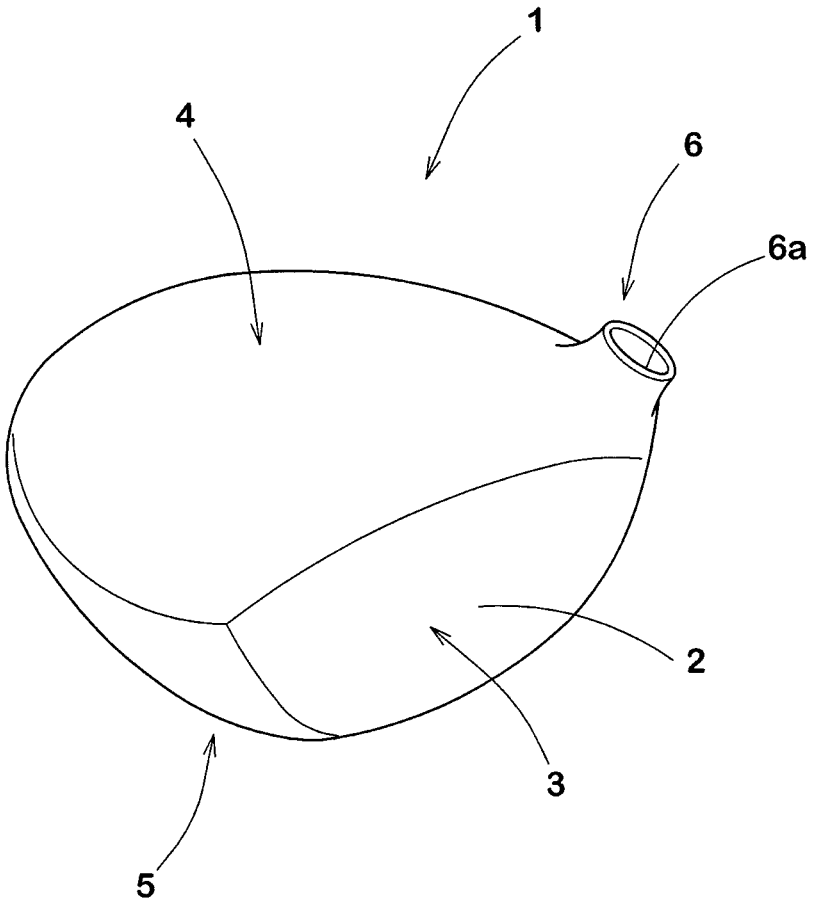
FIG. 1 is a perspective view of a golf club head according to one embodiment of the present invention.

Embodiment of the present invention will now be described in detail in conjunction with accompanying drawings. It should be noted that like elements are denoted by the same reference numerals throughout the disclosure.

FIG. 1 shows a perspective view of a hollow golf club head (which may be hereinafter simply referred to as a "head") 1 in accordance with the present invention.

The head 1 has a hollow structure in which a hollow part (i) (shown in FIG. 6) is provided therein. Although the hollow portion (i) is filled with air in this embodiment, a foam or gel for adjusting the head weight may be filled therein at least partially.

Although the head volume of the head 1 is not particularly limited, it is preferably set in a range of not less than 160 $cm^3$, more preferably not less than 200 $cm^3$, but preferably not more than 470 $cm^3$, more preferably not more than 460 $cm^3$. Preferably, the head 1 has mass in a range of not less than 170 g, more preferably not less than 180 g, but preferably not more than 250 g, more preferably not more than 240 g. Such a head 1 provides a large moment of inertia and deeper center of gravity.

For the head 1, wood type heads such as drivers, fairway woods and utility types are preferably employed. The head 1 in accordance with the embodiment is, for example, a driver.

Figure 2:
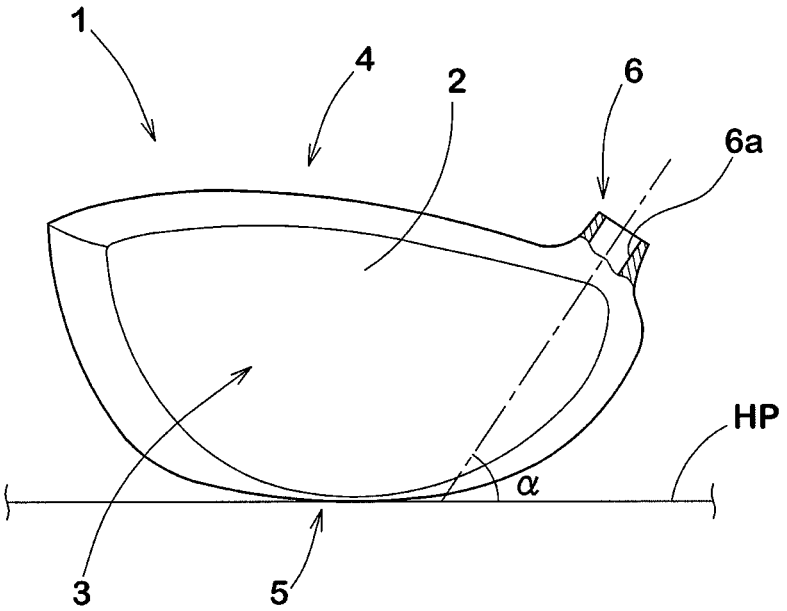
FIG. 2 is a front view of the head in FIG. 1 under a standard state.
Figure 3:
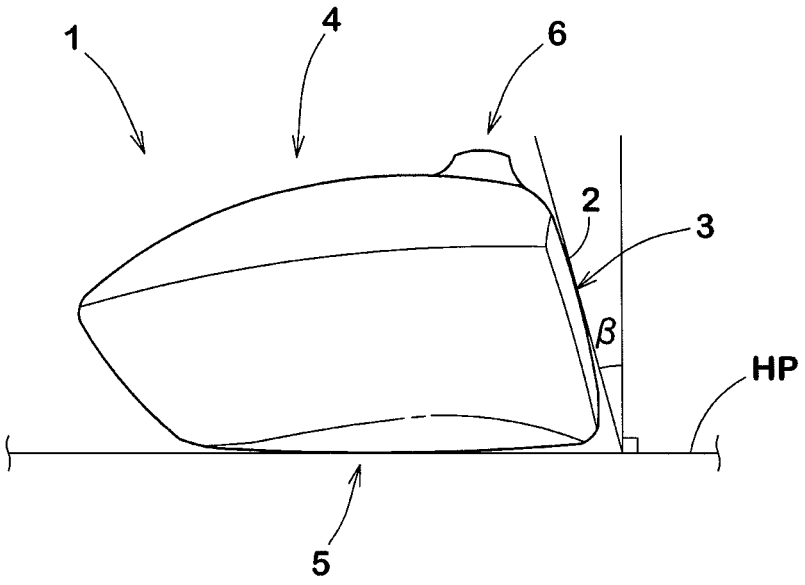
FIG. 3 is a side view of the head in FIG. 2 viewed from its toe side.
Figure 4:
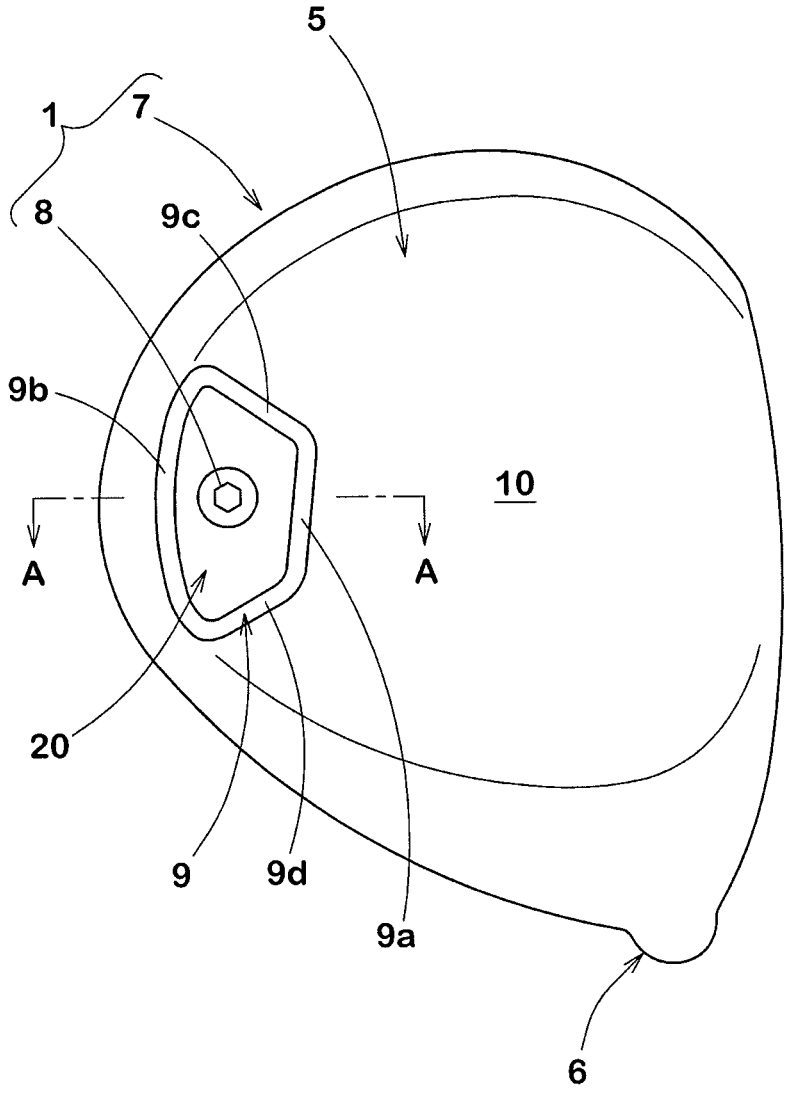
FIG. 4 is a bottom view of the head in FIG. 2.

FIGS. 2 to 4 show the head 1 being placed under a standard state. Here, the standard state mentioned above is a specific position of the head 1 that defines the relationship between the head 1 and a horizontal plane HP, and which means that the head 1 is placed on the horizontal plane HP at its specified lie angle $\alpha$ and loft angle $\beta$.

Referring to FIGS. 1 to 4, the head 1 comprises a face portion 3 having a face 2 for hitting a golf ball, a crown portion 4 forming a top surface of the head, a bottom portion 5 forming a bottom surface of the head, and a hosel portion 6 having a cylindrically shaped shaft insertion hole 6*a* into which a golf club shaft (not shown) is inserted.

Referring to FIG. 4, the bottom portion 5 of the head 1 is defined as a visible area from the bottom view of the head 1, under the standard state. Typically, such the bottom portion 5 may include so-called sole and side portions of a typical wood type golf club head.

Figure 5:
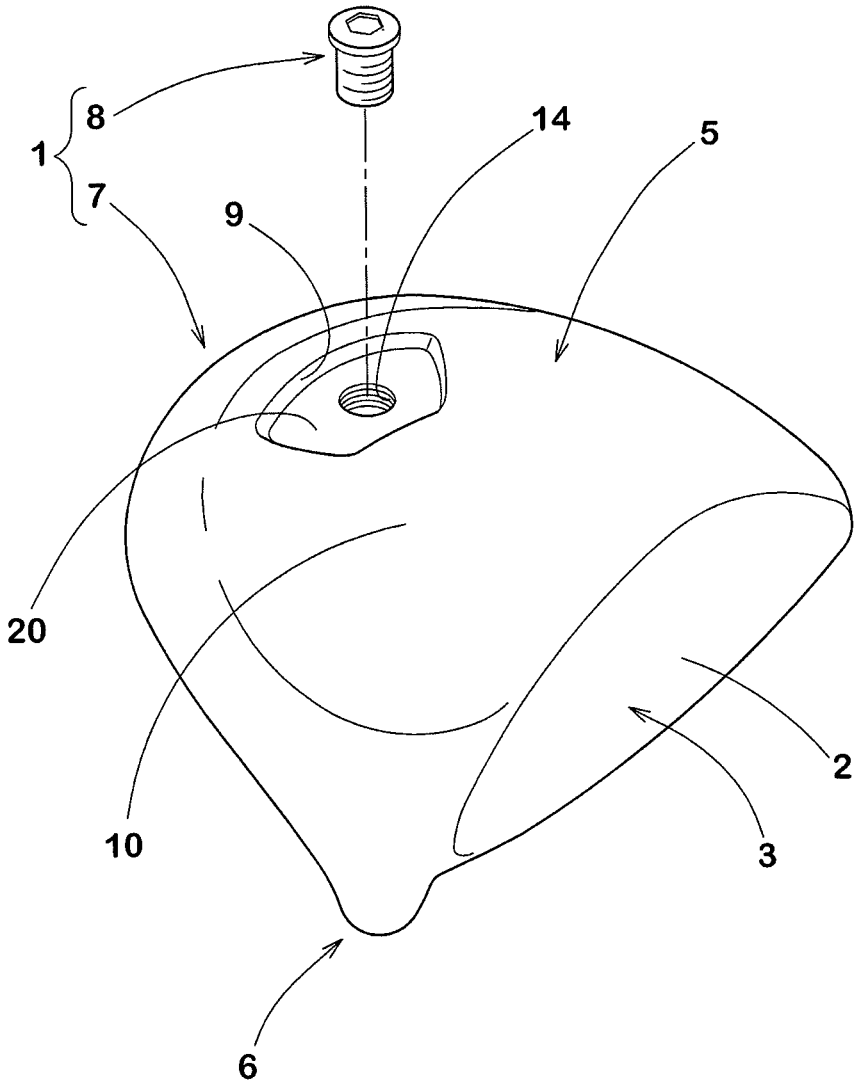
FIG. 5 is an exploded perspective views of the head viewed from its bottom side.

FIG. 5 shows an exploded perspective views of the head 1 viewed from its bottom side. The head 1 comprises a head main body 7 made of a metallic material and at least one weight member 8 attached to the head main body 7.

The head main body 7 comprises the face portion 3, the top portion 4 (not shown in FIG. 5), the bottom portion 5 and the hosel portion 6. Accordingly, the head main body 7 constitutes a major portion of the head 1. For the head main body 7, stainless steel, maraging steel, pure titanium, or titanium alloy and the like may be adopted, for example. The head main body 7 in the present embodiment is made of a titanium alloy.

The bottom portion 5 of the head main body 7 includes a first portion 10, a second portion 20 having a difference in level with respect to the first portion 10, and a slant wall 9 between the first portion 10 and the second portion 20.

The first portion 10 has smoothly convex surface which protrudes toward outside of the head.

Figure 6:
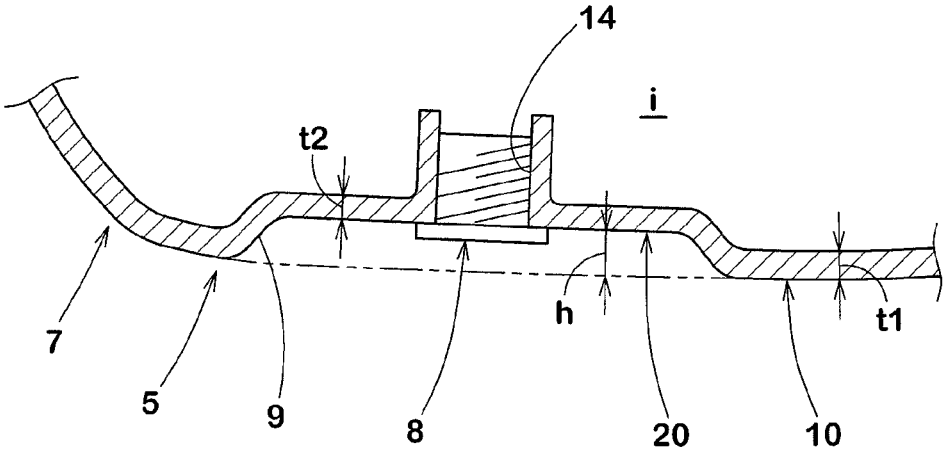
FIG. 6 is a cross sectional view of the head taken along the line A-A in FIG. 4.

FIG. 6 shows a cross sectional view of the head 1 taken along the line A-A in FIG. 4. The slant portion 9 connects between the first portion 10 and the second portion 20 so as to form a stepped portion. In this embodiment, the second portion 20 has a dented surface from the outer surface of the first portion 10 so that a recess is provided on the bottom portion 5.

Figure 7:
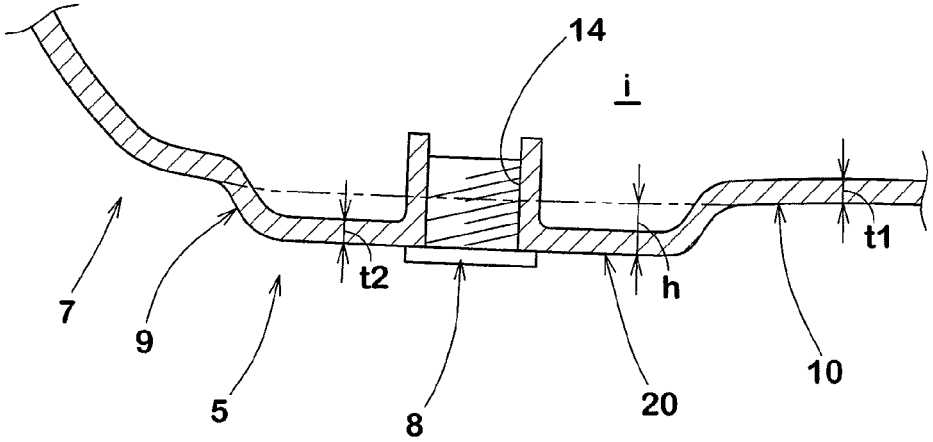
FIG. 7 is a cross sectional view of the head in accordance with another embodiment taken along the line A-A in FIG. 4.

FIG. 7 shows a cross sectional view of the head 1 taken along the line A-A in FIG. 4 in accordance with the other aspect of the present invention. Referring to FIG. 7, the second portion 20 has a protruding surface from the outer surface of the first portion 10 so that a bulge is provided on the bottom portion 5 in this embodiment.

Figure 8A:
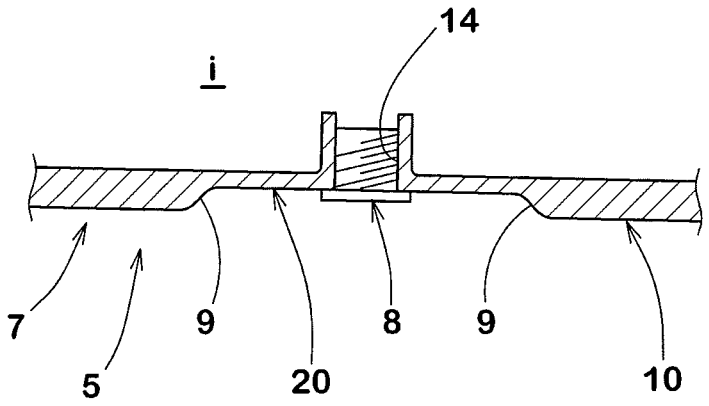
FIGS. 8A and 8B are cross sectional views of the head each showing the other embodiment taken along the line A-A in FIG. 4.

FIG. 8A shows a cross sectional view of the head 1 taken along the line A-A in FIG. 4 in accordance with yet another aspect of the present invention. Referring to FIG. 8A, although the second portion 20 has a dented outer surface from the outer surface of the first portion 10, the inner surface of the second portion 20 is smoothly connected with the inner surface of the first portion 10 without the slant wall 9.

Figure 8B:
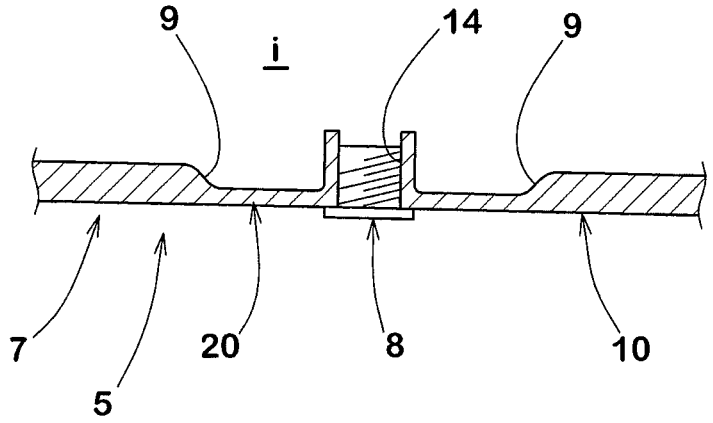

FIG. 8B shows a cross sectional view of the head 1 taken along the line A-A in FIG. 4 in accordance with still further aspect of the present invention. Referring to FIG. 8B, although the second portion 20 has a flat outer surface which smoothly connected with the outer surface of the first portion 10, the inner surface of the second portion 20 is dented from the inner surface of the first portion 10 through the slant wall 9.

In the preferable embodiment, the second portion 20 has an area which is smaller than that of the first portion 20. However, the present invention is not particularly limited to the aspect mentioned above.

The weight member 8 is made of a metallic material that has a specific gravity being larger than that of the head main body 7. For the weight member 8, tungsten, tungsten alloy, copper alloy, nickel alloy, or the like are suitably employed. In case that the head main body 7 is made of a titanium alloy, the weight member is preferably employed a metallic material that has a specific gravity in a range of not less than 5.0, more preferably not less than 6.0, still further preferably not less than 7.0.

One weight member 8 is attached to the head main body 7 in this embodiment. The weight member 8 has a screw like shape to fit a threaded hole 14 provided on the head main body 7. However, the shape, the number, and the attachment method of the weight member 8 are not particularly limited to the embodiment mentioned above.

The weight member 8 is attached to the second portion 20 of the bottom portion 5 of the head main body 7. The vibration of the bottom portion 5 of the head 1 significantly influences the hitting sound of the head. In case that the weight member 8 is attached to the bottom portion 5 of the head main body 7, a primary natural frequency of the bottom portion 5 tends to be low. Accordingly, since the vibration on the bottom portion 5 generated at when the head 1 hits a ball tends to have long cycle, the hitting sound of the head 1 tends to be low.

In order to further lower the hitting sound mentioned above, the present invention provides the weight member 8 on the second portion 20 that is connected with the first portion 10 having difference in level through the slant wall 9. Since the second portion 20 has low rigidity as well as heavy weight due to the weight member 8, the second portion 20 locally vibrates easily so as to further lower the hitting sound. Accordingly, the head 1 in accordance with the present embodiment delivers low hitting sound in which professional golfers tend to like, using a simple head construction.

The location of the weight member 8 may be decided to a certain position in the bottom portion 5 according to a design for weight distribution, for example. The location of the second portion 20 may be decided according to the previously decided location of the weight member 8.

In the preferable aspect of the present invention, the weight member 8 is provided backwardly than the gravity center of the head 1 to get a deeper gravity center of the head. In the other aspect of the present invention, the weight member 8 may be provided at a heel side or toe side to shift the gravity center of the head.

Referring to FIG. 6, the slant wall 9 between the first portion 10 and the second portion 20 preferably has a height h in a range of from not less than 1.0 mm, more preferably not less than 2.0 mm in order to effectively lower the natural frequency of the head 1. The height h of the slant wall 9 is defined as the difference between two surfaces of the first and second portions 10, 20. The height h of the slant wall 9 is preferably in a range of not more than 10.0 mm, more preferably not more than 8.0 mm in order to maintain durability of the head 1.

Preferably, the slant wall 9 is provided so as to continuously surround the second portion 20. In case that the secondary vibration mode of the head is considered, at least a pair of facing slant walls 9 may be provided on both sides of the second portion 20. In further preferable embodiment, referring to FIG. 4, the slant wall 9 comprises a first wall 9*a* and a second wall 9*b* both of which extend in toe-heel direction of the head and face each other. In yet preferable embodiment, the slant wall 9 comprises a third wall 9*c* and a fourth wall 9*b* both of which extend in front-back direction of the head.

Although the shape of the second portion 20 of the head 1 is not particularly limited, the second portion 20 is preferably provided around the weight member 8 in order to effectively vibrate the second portion 20. More preferably, the second portion 20 is continuously provided around the weight member 8.

In order to further lower hitting sound of the head, the second portion 20 has a thickness t2 smaller than a thickness t1 of the first portion 10, shown in FIG. 6. In one aspect of the present invention, the thickness t2 of the second portion 20 is preferably in a range of from 0.5 to 2.0 mm in order to vibrate the second portion 20 easily while maintaining durability of the head.

In order to effectively obtain advantage mentioned above, the difference t1−t2 between the thickness t1 of the first portion 10 and the thickness t2 of the second portion 20 is preferably in a range of not less than 0.1 mm, more preferably not less than 0.2 mm. In order to maintain durability of the head, the difference t1−t2 mentioned above is preferably in a range of not more than 2.5 mm, more preferably not more than 2.0 mm.

Figure 9:
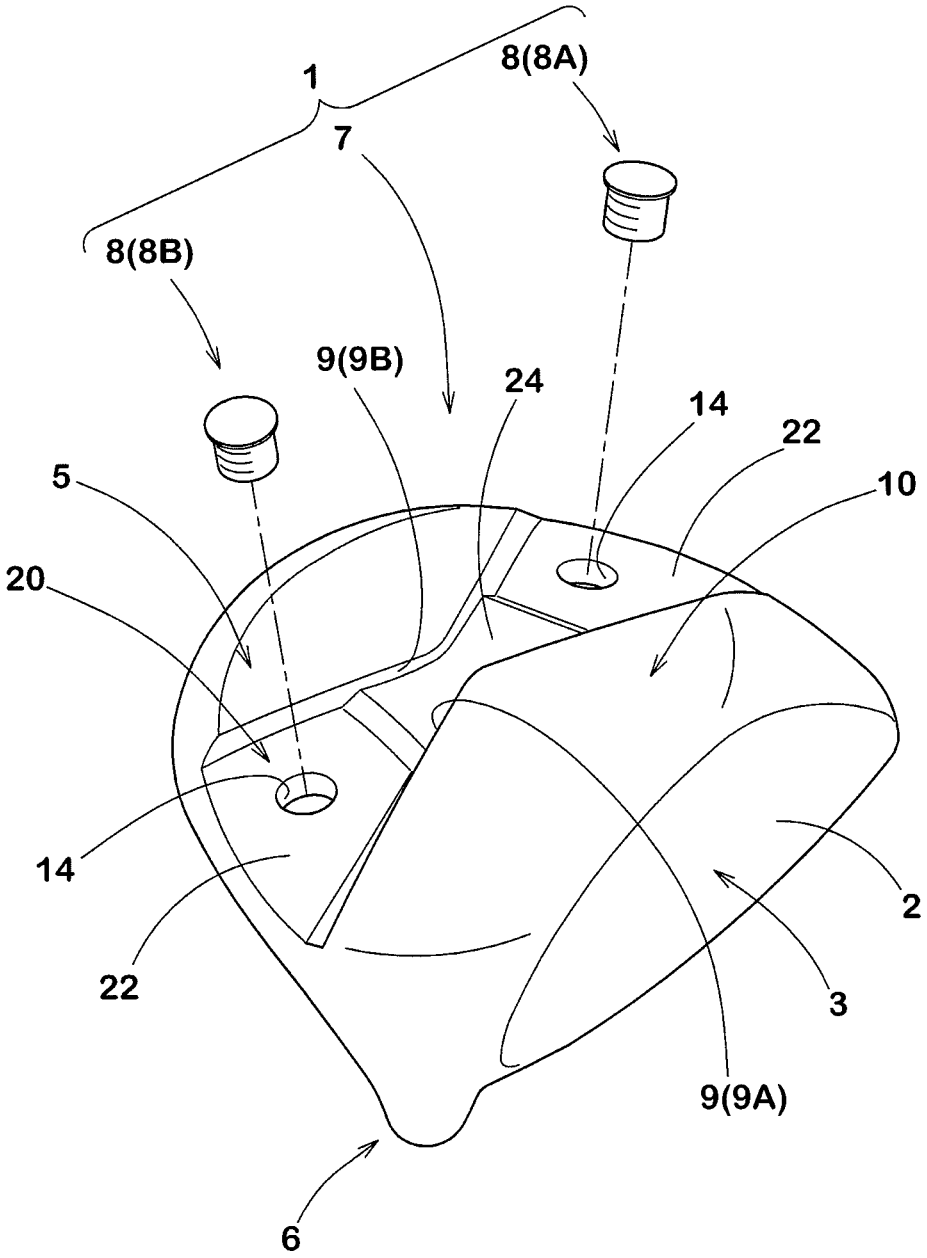
FIG. 9 is an exploded perspective views of the head viewed from its bottom side in accordance with the other embodiment.
Figure 10:
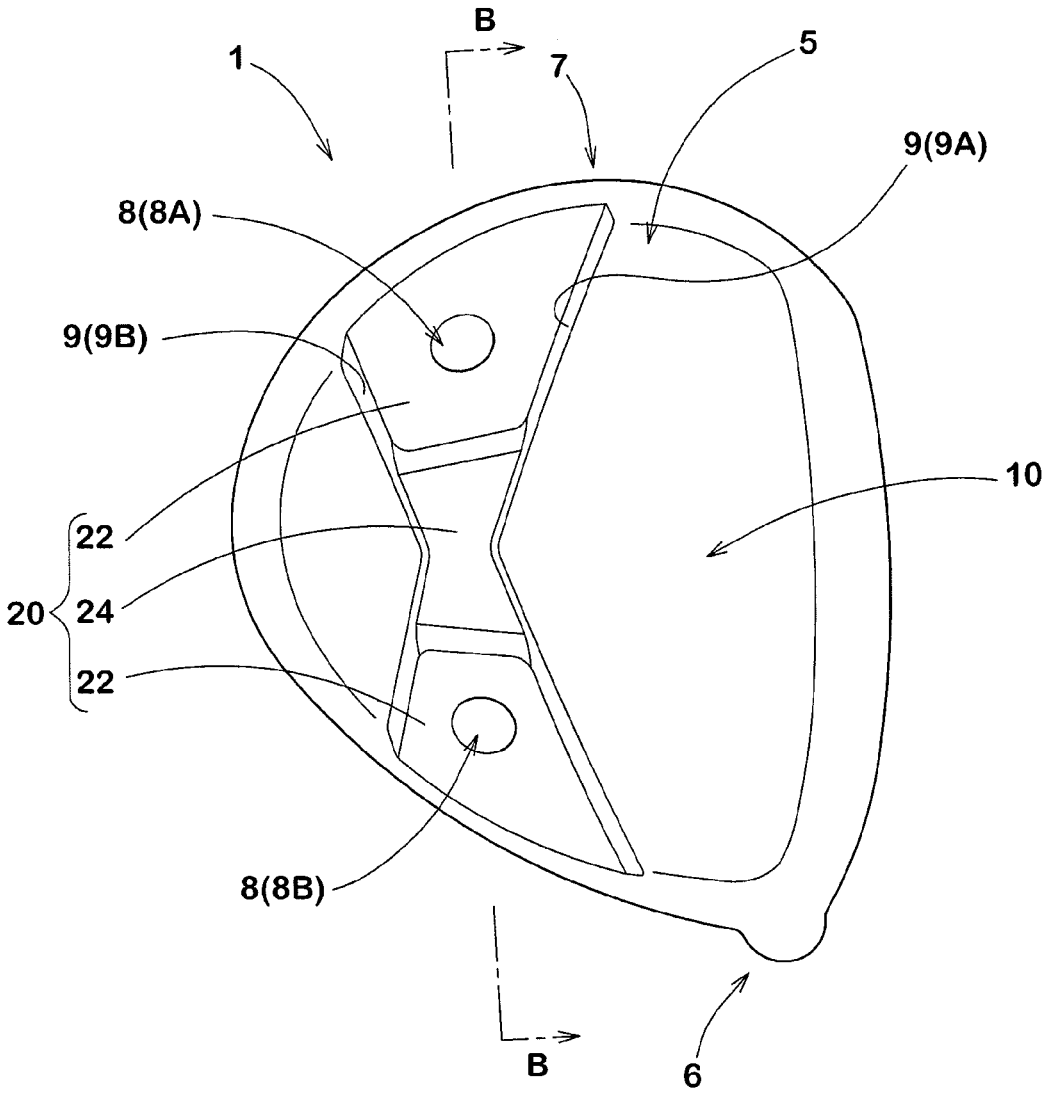
FIG. 10 is a bottom view of the head shown in FIG. 9.
Figure 11:
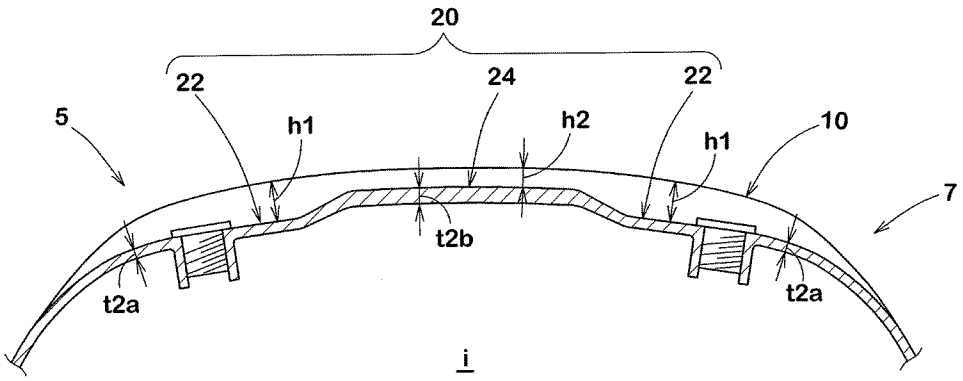
FIG. 11 is a cross sectional view of the head taken along the line B-B in FIG. 10.

FIG. 9 shows an exploded perspective views of the head 1 viewed from its bottom side in accordance with the other embodiment. FIG. 10 shows a bottom view of the head shown in FIG. 9 and FIG. 11 shows a cross sectional view of the head taken along the line B-B in FIG. 10.

The head 1 in accordance with the present embodiment comprises the bottom portion 5 including the recessed second portion 20 where two separate weight members are attached.

The second portion 20 is provided so as to extend widely in the toe-heel direction of the head on the bottom portion 5. The second portion 20 in accordance with the present embodiment has a longitudinal width along in the front-back direction of the head which gradually enlarges toward the heel and toe sides from its center. The slant wall 9 comprises a front wall 9A which extends the toe-heel direction of the head at the side of the face 2, and a rear wall 9B which extends the toe-heel direction of the head at the side of the rear of the head. The toe and heel sides of second portion 20 are smoothly connected with the first portion 10 (the side portion), respectively.

The weight members 8 comprise a first weight member 8A provided at the toe side of the second portion 20 and a second weight member 8B provided at the heel side of the second portion 20. By offering two separate weight members 8A and 8B within the second portion 20, each of the toe and heel sides of second portion 20 may independently vibrate so that the further lower hitting sound is obtained.

Preferably, the second portion 20 further includes at least one primary portion 22 and at least one secondary portion 24. The primary portion 22 has a height h1 from the first portion 10 that is larger than a height h2 of the secondary portion 24 (shown in FIG. 11). In this embodiment, the second portion 20 comprises one secondary portion 24 and two primary portions 22 provided on the toe side and heel side of the secondary portion 24. In this embodiment, each primary portion 22 has the weight member 8A or 8B.

Since the second portion 20 with the primary portions 22 easily vibrates compared with the first portion 10, further low hitting sound may be obtained. Additionally, since the secondary portion 24 helps to increase rigidity of the second portion 20, durability of the head 1 is also maintained.

Preferably, the secondary portion 24 has a thickness t2*b* which is larger than the thickness t2*a* of the primary portion 22, in order to surely obtain not only low hitting sound, but also improved durability of the bottom portion 5.

Although the present invention has been described so far in detail, the present invention is not limited to the specific embodiments described above and may be changed to different aspects as needed.

Comparative Test:

In order to confirm advantage of the present invention, a plurality of golf club heads having a major structure shown in FIGS. 1 to 5 and table 1 were manufactured, and the primary natural frequency of each head was measured.

Figure 12:
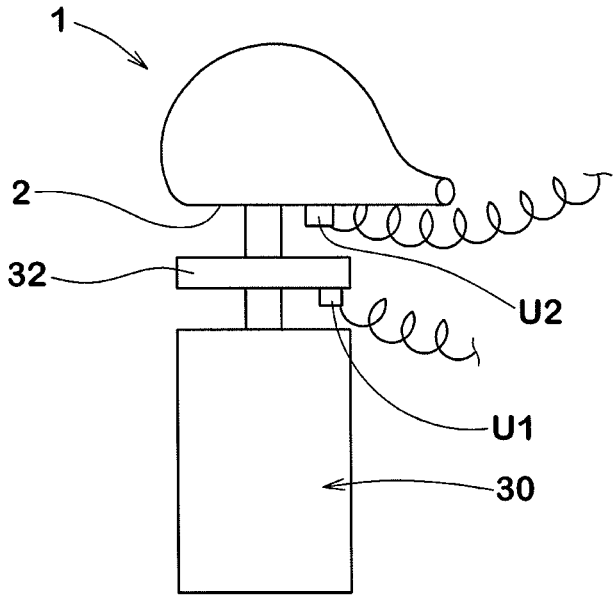
FIG. 12 is a schematic for explaining a measurement method of a natural frequency of a golf club head.

The natural frequency of the head was measured as follows. Referring to FIG. 12, the face 2 of the test head 1 was attached to a mount table 32 of a vibrator 30 (model PET-01, PET-0A manufactured by International Mechanical Vibration Co.). Acceleration pickups u2, u1 were also attached to the face 2 of the test head 1 and the vibrator 30, respectively. Then, using a dynamic signal analyzer (model HP-5420A manufactured by YHP), the output signals of the pickups u1, u2 when the club face 2 was vibrated at a variable frequency were processed and analyzed to obtain the primary natural frequency of the test head. The smaller the primary natural frequency is, the lower the hitting sound is.

The respective club heads have all identical specifications as follows except for the parameters listed in Table 1. The club head of Ref. 1 has no second portion in the bottom portion. The example club heads Nos. 1 to 7 have different parameters with respect to thicknesses of second portions or heights of slant walls.

Loft angle: 10.0 deg.

Lie angle: 57.5 deg.

club head volume: 450 $cm^3$

Head main body: Ti-6Al-4v except face portion of TIX51AF

Table 1 shows test results and the like.

TABLE 1

| | Ref. 1 | Ex. 1 | Ex. 2 | Ex. 3 | Ex. 4 | Ex. 5 | Ex. 6 | Ex. 7 |
|---|---|---|---|---|---|---|---|---|
| Head type | FIG. 5 | FIG. 5 | FIG. 5 | FIG. 5 | FIG. 5 | FIG. 5 | FIG. 5 | FIG. 5 |
| Thickness t1 of first portion (mm) | 0.7 | 0.7 | 0.8 | 0.8 | 1.2 | 0.8 | 0.8 | 0.8 |

TABLE 1-continued

| | Ref. 1 | Ex. 1 | Ex. 2 | Ex. 3 | Ex. 4 | Ex. 5 | Ex. 6 | Ex. 7 |
|---|---|---|---|---|---|---|---|---|
| Thickness t2 of second portion (mm) | 0.7 | 0.7 | 0.8 | 0.7 | 0.9 | 0.7 | 0.7 | 0.7 |
| Slant wall | None | FIG. 6 | FIG. 6 | FIG. 6 | FIG. 6 | FIG. 6 | FIG. 6 | FIG. 6 |
| Height h of slant wall (mm) | 0 | 4 | 4 | 4 | 4 | 6 | 8 | 10 |
| Head main body mass (g) | 198 | 199 | 200 | 199 | 202 | 201 | 202 | 203 |
| Weight member mass (g) | 20 | 20 | 20 | 20 | 20 | 20 | 20 | 20 |
| Primary natural frequency (Hz) | 2300 | 2100 | 2150 | 2050 | 1950 | 2000 | 1950 | 1900 |

* Ref. 1 has no second portion in the bottom portion.

Next, a plurality of golf club heads according to the aspect shown in FIGS. 9 to 11 and Table 2 were manufactured, and tested about primary natural frequency of heads and durability. In the durability test, each club head was attached to a shaft to make a wood type golf club, and the golf club was mounted on a swing robot. The club head struck golf balls repeatedly up to 60,000 times and the number of hitting times until any damage was caused in the face portion was counted.

The club head of Ref. 2 has no second portion in the bottom portion. The example club heads Nos. 8 to 14 have different parameters with respect to thicknesses of second portions or heights of slant walls.

The test results are shown in Table 2.

TABLE 2

| | Ref. 2 | Ex. 8 | Ex. 9 | Ex. 10 | Ex. 11 | Ex. 12 | Ref. 3 |
|---|---|---|---|---|---|---|---|
| Head type | FIG. 10 | FIG. 10 | FIG. 10 | FIG. 10 | FIG. 10 | FIG. 10 | FIG. 10 |
| Thickness t1 of first portion (mm) | 0.7 | 0.7 | 0.8 | 0.8 | 1.2 | 1.2 | 0.7 |
| Thickness t2a of primary portion (mm) | 0.7 | 0.7 | 0.8 | 0.7 | 0.7 | 0.7 | 0.7 |
| Thickness t2b of secondary portion (mm) | 0.7 | 0.7 | 0.8 | 0.7 | 0.9 | 0.9 | 0.7 |
| Slant wall | None | FIG. 6 | FIG. 6 | FIG. 6 | FIG. 6 | FIG. 6 | None |
| Height h1 of primary portion (mm) | 0 | 4 | 4 | 4 | 6 | 8 | 0 |
| Height h2 of secondary portion (mm) | 0 | 1 | 1 | 1 | 1 | 2 | 0 |
| Head main body mass (g) | 198 | 199 | 200 | 199 | 203 | 204 | 229 |
| Weight member mass Toe side-Heel side (g) | 10 · 10 | 10 · 10 | 10 · 10 | 10 · 10 | 10 · 10 | 10 · 10 | 25 · 25 |
| Primary natural frequency (Hz) | 2300 | 1950 | 2000 | 1900 | 1850 | 1750 | 1950 |
| Durability | 54500 | 55121 | 55210 | 55150 | 56231 | 56121 | 40026 |

* Ref. 2 has no second portion in the bottom portion.

It was confirmed that each club head in accordance with the present invention delivered preferable low hitting sound. Additionally, it was confirmed that the club head having large second portion maintained preferable durability.

The invention claimed is:

1. A hollow type golf club head comprising:

a head main body including a metallic material, the head main body comprising:

a sole portion comprising:

a primary sole portion having a sole thickness between 0.7 and 1.2 mm; and a recessed portion being recessed relative to the primary sole portion, the recessed portion including a bottom wall and a side wall that is slanted relative to the primary sole portion, the bottom wall having a bottom wall thickness that is between 0.5 and 1.0 mm and at least 0.2 mm less than the sole thickness, the bottom wall including at least a first tier and a second tier, the first tier having a first height measured normal to a general contour of an exterior surface of the sole portion and the second tier having a second height measured normal to the general contour of the exterior surface of the sole portion;

a weight port within the bottom wall; and a weight insert secured within the weight port, wherein the first height and the second height are different.

2. The hollow type golf club head of claim 1, wherein the recessed portion is located on one of a toe region, a heel region, or a central region of the sole portion.

3. The hollow type golf club head of claim 1, wherein the bottom wall of the recessed portion further comprises:

a third tier having a third height measured normal to the general contour of the exterior surface of the sole portion, wherein the third height is less than both the first height and second height.

4. The hollow type golf club of claim 3, wherein the first tier comprises the weight port.

5. The hollow type golf club of claim 4, wherein the second tier comprises:

a second weight port comprising a second weight.

6. The hollow type golf club head of claim 3, wherein:

the first tier has a first thickness;

the second tier has a second thickness; and the third tier has a third thickness, wherein the third thickness is one of greater than or less than both the first thickness and second thickness.

7. The hollow type golf club head of claim 1, wherein the weight insert has a specific gravity greater than a specific gravity of the head main body.

8. The hollow type golf club of claim 1, wherein the side wall has a wall thickness that is less than or equal to the sole thickness and greater than or equal to the bottom wall thickness.

9. The hollow type golf club of claim 1, wherein the bottom wall of the recessed portion has a height between 4 mm and 8 mm measured normal to a general contour of an exterior of the primary sole portion.

10. The hollow type golf club of claim 1, wherein the sole portion is made of the metallic material.

11. The hollow type golf club of claim 1, wherein the sole portion comprises at least one of stainless steel, maraging steel, pure titanium, and titanium alloy.

12. A hollow type golf club head comprising:

a head main body including a metallic material, the head main body comprising:

a sole portion comprising:

a primary sole portion having a sole thickness;

a recessed portion within the sole portion having a recess thickness at least 0.2 mm less than the sole thickness, the recessed portion comprising at least a first tier having a first height measured normal to a general contour of an exterior surface of the sole portion and a second tier having a second height measured normal to a general contour of an exterior surface of the sole portion, the second height being different than the first height; and a wall connecting the sole portion and the recessed portion having a wall thickness less than or equal to the sole thickness, the wall being slanted relative to the primary sole portion;

a weight port within the recessed portion; and a weight insert secured within the weight port.

13. The hollow type golf club of claim 12, wherein the recessed portion has a height between 4 mm and 8 mm measured normal to a general contour of an exterior of the primary sole portion.

14. The hollow type golf club of claim 12, wherein the sole portion is made of the metallic material.

15. The hollow type golf club of claim 12, wherein the sole portion comprises at least one of stainless steel, maraging steel, pure titanium, and titanium alloy.

16. The hollow type golf club of claim 12, wherein the wall thickness is greater than or equal to the recess thickness.

17. A hollow type golf club head comprising:

a head main body including a metallic material, the head main body comprising:

a sole portion comprising:

a primary sole portion having a sole thickness between 0.7 and 1.2 mm;

a protruded portion extending outward from the primary sole portion having a protrusion thickness between 0.5 and 1.0 mm and at least 0.1 mm less than the sole thickness, the protruded portion comprising at least a first tier having a first height measured normal to a general contour of an exterior surface of the sole portion and a second tier having a second height measured normal to a general contour of an exterior surface of the sole portion, the second height being different than the first height;

a wall connecting the sole portion and the protruded portion;

a weight port within the protruded portion; and a weight secured within the weight port.

18. The hollow type golf club of claim 17, wherein the protruded portion has a height between 4 mm and 8 mm measured normal to a general contour of an exterior of the sole portion.

19. The hollow type golf club of claim 17, wherein the sole portion is made of the metallic material.

20. The hollow type golf club of claim 17, wherein the sole portion comprises at least one of stainless steel, maraging steel, pure titanium, and titanium alloy.

* * * * *